US005738508A

United States Patent [19]

Döbbeling et al.

[11] Patent Number: 5,738,508

[45] Date of Patent: Apr. 14, 1998

[54] BURNER

[75] Inventors: Klaus Döbbeling, Windisch; Hans Peter Knöpfel, Besenbüren; Wolfgang Polifke, Windisch, all of Switzerland; Peter Senior, Leicester, Great Britain

[73] Assignee: ABB Research Ltd., Zurich, Switzerland

[21] Appl. No.: 597,029

[22] Filed: Feb. 5, 1996

[30] Foreign Application Priority Data

Apr. 25, 1995 [DE] Germany ..... 195 15 082.1

[51] Int. Cl.[6] ..... F23D 14/46

[52] U.S. Cl. ..... 431/350; 431/173; 431/351; 431/354

[58] Field of Search ..... 431/350, 353, 431/354, 351, 173, 284, 285, 177, 178, 159, 8, 2; 60/743

[56] References Cited

U.S. PATENT DOCUMENTS 4,781,030 11/1988 Hellat et al. ..... 431/350

FOREIGN PATENT DOCUMENTS

0321809B1 6/1989 European Pat. Off. .
0436113A1 7/1991 European Pat. Off. .
288610 11/1915 Germany .

*Primary Examiner*—James C. Yeung
*Attorney, Agent, or Firm*—Burns, Doane, Swecker & Mathis, L.L.P.

[57] ABSTRACT

In a burner (1) for heat generation, the inflowing air (4) is first of all directed into a hollow conical swirl generator (3) which is surrounded by a mixing tube (2). This swirl generator (3) tapers in the direction of flow in such a way that a hollow cone results therefrom. Furthermore, the swirl generator (3) has tangential openings (6, 7) in the direction of flow, which are preferably designed as ducts through which the combustion air (5) flows out of the hollow space (16) into the mixing tube (2). In the region of the tangential openings (6, 7), nozzles (12, 13) are provided through which a fuel (14) is injected into the combustion air (5) flowing past there. A fuel, whether liquid or gaseous, may be supplied by further means in operative connection with the burner (1).

9 Claims, 5 Drawing Sheets

BURNER

BACKGROUND OF THE INVENTION

1. Field of the Invention

The present invention relates to a burner.

2. Discussion of Background

U.S. Pat. No. 4,932,861 to Keller et al. has disclosed a conical premix burner which consists Of several shells and produces a closed swirl flow in the cone head. The swirl flow becomes unstable along the cone tip on account of the increasing swirl and changes into an annular swirl flow. In combination with the sudden widening in the cross section provided at the cone tip, the annular flow causes a backflow zone on the burner axis. Gaseous fuels are injected here along the tangential ducts (also called air-inlet slots) formed by the individual shells and are mixed homogeneously with the combustion air flowing in. The combustion starts by ignition at the stagnation point of the backflow zone or backflow bubble, the backflow zone thus fulfills the function of a bodiless flame retention baffle. However, the last nozzles for this gaseous fuel in the direction of flow lie very close to the burner outlet and thus in proximity to the flame. Accordingly, the fuel introduced through these nozzles does not mix with the air in an optimum manner and tends to lead to higher NOx emissions. If the intention is to extend the premix section in order to keep the NOx emissions to a minimum, this requires a complicated transition piece between the burner body and the following part. The flow field produced downstream by the premix burner leads to problems in a following tube either at the margin or at the center on account of the low axial velocity. This then leads to backfiring and the premix burner cannot be operated at an optimum level in the transient regions in this manner. Liquid fuels are preferably introduced here via a central nozzle at the burner head. The liquid fuels vaporize in the conical hollow space. Under conditions specific to gas turbines, the ignition .of these liquid fuels takes place relatively early and consequently always near the fuel nozzle, which in turn inevitably leads to the threat of a potential increase in the NOx emissions precisely on account of this non-optimum mixing, which threat has to be counteracted, for example, by water injection. Further problems arising from the operation with a liquid fuel are connected with the relatively small cross section of flow and consequently with the small cone angle which might arise from that in the region of the atomization angle of the fuel nozzle. This factor may easily lead to wetting of the cone shells and thus to harmful cracking processes with regard to the pollutant emissions as soon as a pressure difference occurs for example. In addition, it should be realized that the attempt to fire hydrogenous gases (MBTU or LBTU gases) like natural gas has led to premature ignition at the nozzles for a gaseous fuel along the tangential ducts. Attempts to remedy this have involved the introduction of a special injection method for such gaseous fuels at the burner outlet, although the results of this injection method have not been entirely satisfactory.

SUMMARY OF THE INVENTION

Accordingly, one object of the invention is to propose novel measures in the case of a burner of the type mentioned at the beginning which are able to remove the abovementioned disadvantages.

The premix burner according to the invention consists of a conical swirl generator which is made with at least two tangentially arranged slots. The combustion air flows here axially into the swirl generator and then to the outside via the said tangential slots or ducts, this conical swirl generator being enclosed by a body preferably designed as a tube. Since the shape of this body exerts a great effect on the flow outside and downstream of the swirl generator, it may still be changed after the swirl generator by suitable measures. Thus the cross section of the body enclosing the swirl generator may decrease in the direction of flow, for example by means of a cone or venturi. A gaseous fuel may also be introduced here by nozzles which are located in the region of the slots. If the burner is operated with a liquid fuel, the fuel is fed into the cross section of the enclosing body in the region of the tip of the conical swirl generator. If an MBTU or LBTU gas is introduced, the relatively large quantity of this fuel can be introduced directly from outside into the cross section of the enclosing body, whereby the mixing with the swirl flow prevailing there is likewise ensured.

The essential advantages of the invention may be seen in the fact that the flow field after the swirl generator can be freely modulated. Furthermore, it should be emphasized that the injection of a liquid fuel does not lead to wetting of the flow wall of the enclosing body, because the cross section of flow is maximized precisely in this plane. Thus, thanks to the large spray angle which is thus possible, optimum mixing with the swirled combustion air is successfully achieved. The long premix section now possible downstream of the swirl generator minimizes the NOx emissions from the subsequent combustion. The good accessibility for MBTU and LBTU gases has already been dealt with above. Furthermore, it should be noted that the burner front of the burner according to the invention need no longer be cooled. Sealing problems between premix and head stage also no longer occur here.

Due to the simple geometry of the burner according to the invention, air can be directed into the tip of the swirl generator in an uncomplicated manner, which air may be utilized to make the mixture leaner or to produce an axial jet on the burner axis. If the burner is operated with a liquid fuel, this air may also be utilized to assist the atomization in a more simple manner compared with the premix burner belonging to the prior art. The inverse arrangement of the burner according to the invention compared with the said prior art, as far as the swirl generation is concerned, improves the atomization of the liquid fuel, in the course of which deposits in the region of the shells of the swirl generator are impossible. If the flow in the outer region is to be orientated purely axially or made leaner, this may be achieved by the swirl body not covering the entire cross section of the enclosing body.

Advantageous and expedient further developments of the achievement of the object according to the invention are defined in the further claims.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

To better understand the structure of the premix burners described below, the corresponding front view should be used at the same the as the individual figures in elevation.

Figures 1, 2:
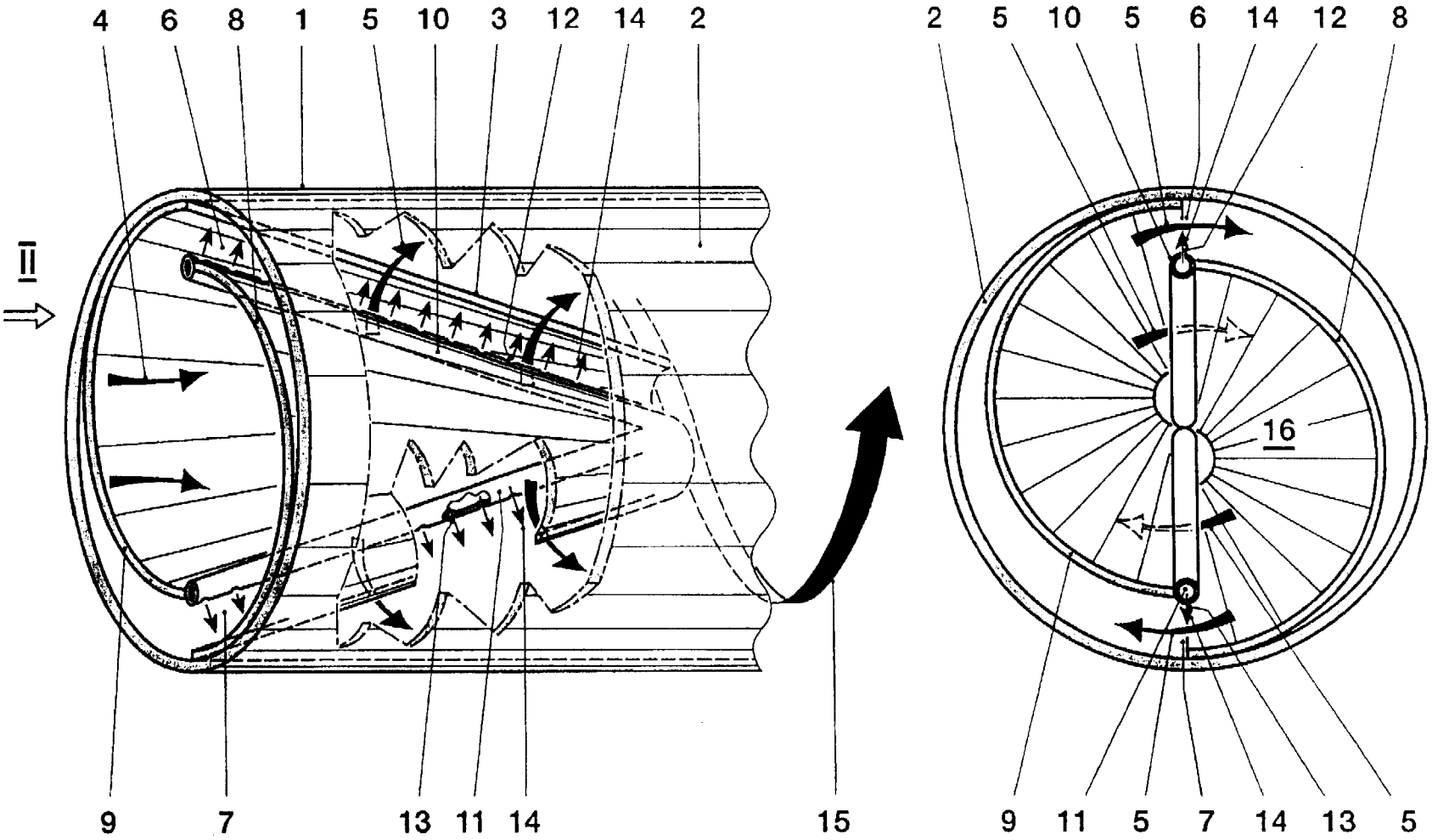
FIG. 1 shows a side sectional view of a premix burner.
FIG. 2 shows a front view of the premix burner according to FIG. 1.

Referring now to the drawings, wherein like reference numerals designate identical or corresponding parts throughout the several views, FIG. 1 shows a premix burner 1 which consists of a tubular body 2 and a hollow, conical swirl generator 3 integrated therein. The swirl generator 3 is positioned to narrow in the direction of flow. The air 4 flowing into the swirl generator flows in axially into the interior 16 of the conical swirl generator and from there, flows tangentially or quasi-tangentially, as the arrows 5 are intended to symbolize, from the inside to the outside. Tangential ducts 6, 7 are provided here for this purpose. The tangential ducts 6, 7 are formed by nesting at least two hollow, conical sectional bodies 8, 9 to define a conical interior space 16 with the center axes of these sectional bodies 8, 9 mutually offset. In certain operating configurations, it is not out of the question for the swirl generator 3 to consist of a single spiral. As outlined briefly above, the mutual offset of the respective center axis or longitudinal symmetry axis of the conical sectional bodies 8, 9 in each case creates the tangential ducts 6, 7 at the adjacent wall. The tangential ducts 6, 7 provide gas through which the combustion air 5 flows from the interior space 16 of the swirl generator 3 into the tube 2.

The conical shape of the sectional bodies 8, 9 shown has a certain fixed angle in the direction of flow. Of course, depending on operational use, the sectional bodies 8, 9 may have increasing or decreasing curvature in the direction of flow, that is, they may be designed like a diffuser or confuser. The two last-mentioned shapes are not shown graphically, since they can readily be imagined by the person skilled in the art. The two conical sectional bodies 8, 9 each have a fuel line 10, 11, which fuel lines 10, 11 are arranged along the tangential ducts 6, 7 and are provided with injection openings 12, 13, through which preferably a gaseous fuel 14 is injected into the combustion air 5 flowing through there, as revealed by the arrows. These fuel lines 10, 11 are preferably arranged in the region of the tangential outflows, predetermined by the ducts 6, 7, from the swirl generator 3 and the inflow into the tube 2, this in order to obtain an optimum air/fuel mixture 15. If the combustion air 5 is additionally preheated or enriched, for example, with a recycled flue gas or exhaust gas, this generally provides lasting assistance for the vaporization of the fuel 14 used, especially if the fuel is a liquid fuel, the injection of which may also be carried out via the said, fuel lines 10, 11. Narrow limits per se are to be adhered to in the configuration of the conical sectional bodies 8, 9 with regard to the cone angle and the width of the tangential ducts 6, 7 so that the desired flow field of the combustion air 5 or the mixture 15 can arise at the outlet of the swirl generator 3. In general it may be said that a reduction in the width of the tangential ducts 6, 7 locally promotes the formation of the critical swirl number, which is jointly responsible for the formation of a backflow zone. It should be said at the same time that a correction in this respect is also possible by influencing the axial velocity in the region of the swirl generator 3. Further details of how this is carried out may be gathered from FIG. 5. The critical swirl number may also be influenced by the width of the tangential ducts 6, 7 being designed to be variable in the direction of flow. If the width of the ducts 6, 7 decreases in the direction of flow, the location of the formation of the backflow zone is displaced downstream. The following comments apply to the formation of the backflow zone: located on the outflow side of the tube 2 is the actual combustion chamber, which is not shown in more detail here. The tube 2 here performs the function of a mixing tube which provides a defined mixing section downstream of the swirl generator 3, in which mixing section perfect premixing is achieved irrespective of the fuel injected. Furthermore, this mixing section permits loss-free guidance of the flow so that for the time being no backflow zone can form even in interaction with the transition geometry appearing in this case, whereby the mixture quality for the respective fuel may be influenced over the length of the mixing tube 2. However, this mixing tube 2 has a further feature, which consists in the fact that, in the mixing tube 2 itself, the axial velocity profile has a pronounced maximum at the axis, so that a flashback of the flame from the combustion chamber is not possible. It is true though that the axial velocity in such a configuration potentially decreases toward the wall. In order to prevent a flashback in this region too, the mixing tube 2, in the direction of flow and in the peripheral direction, may be provided with a number of bores (not shown) of the most varied cross section and direction, through which an air quantity flows into the interior of the mixing tube 2, and can produce an increase in velocity along the wall. Another way of achieving the same effect is for the cross section of flow of the mixing tube 2 to be reduced (likewise not shown in more detail) on the outflow side of the swirl generator 3, as a result of which the overall velocity level within the mixing tube 2 is raised. If the measure selected for guiding the flow within the mixing tube 2 should produce an intolerable pressure loss, this may be remedied by a diffuser (not shown in the figure) being provided at the end of the mixing tube 2. As already mentioned above, the combustion chamber adjoins the end of the mixing tube 2, there being a jump in cross section between the two cross sections of flow. It is not until this point that the central backflow zone is formed, which has the properties of a flame retention baffle, which admittedly is bodiless here. As already indicated, the formation of a stable backflow zone also requires a sufficiently high swirl number in the mixing tube 2. If a fluidic marginal zone develops during operation inside the said jump in cross section, in which marginal zone vortex breakdowns occur due to the vacuum prevailing there, this leads to increased ring stabilization of the backflow zone itself. If a high swirl number is unwelcome to begin with, stable backflow zones may be produced by feeding small swirled air flows at the end of the mixing tube, for example through tangential openings. In this case it is assumed that the required air quantity is about 5–20% of the total air quantity. The design of the swirl generator 3 is especially suitable for designing the tangential ducts 6, 7 with a variable width, whereby a relatively large operational range can be covered without interfering with the overall length of the swirl generator 3. The conical sectional bodies 8, 9 are of course also displaceable relative to one another in another plane, as a result of which even overlapping of the same is possible. Furthermore, it is possible to nest the conical sectional bodies 8, 9 spiral-like one inside the other by a contra-rotating movement. Therefore the shape, size and configuration of the tangential ducts 6, 7 can be varied as desired, whereby the swirl generator 3 has wide operational availability without changing its overall length.

FIG. 2 shows the outflow of the combustion air 5 from the interior space 16 of the swirl generator 3 into the mixing tube 2, the injection of the fuel 14 into the combustion-air flow 5 taking place in the region of the tangential ducts 6, 7. A gaseous fuel is preferably injected in the region of the tangential ducts 6, 7.

Figure 4:
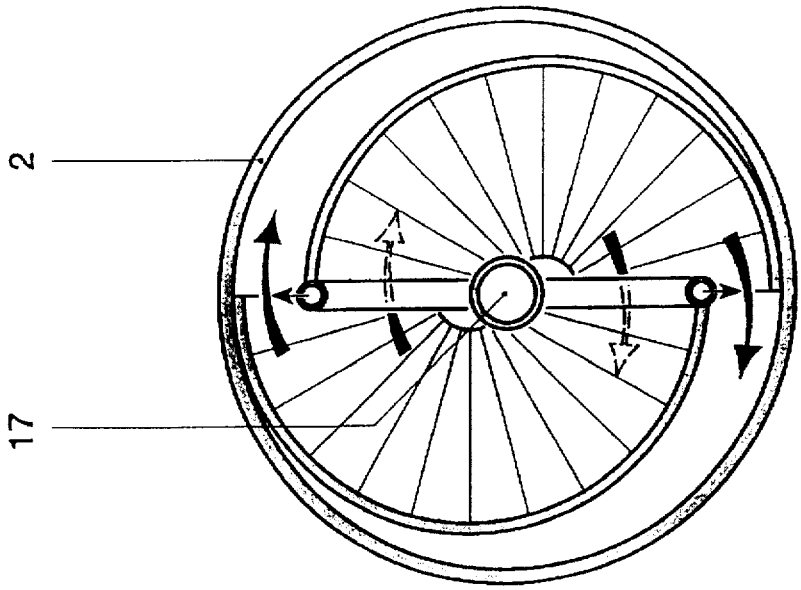
FIG. 4 shows a front view of the premix burner according to FIG. 3.
Figure 3:
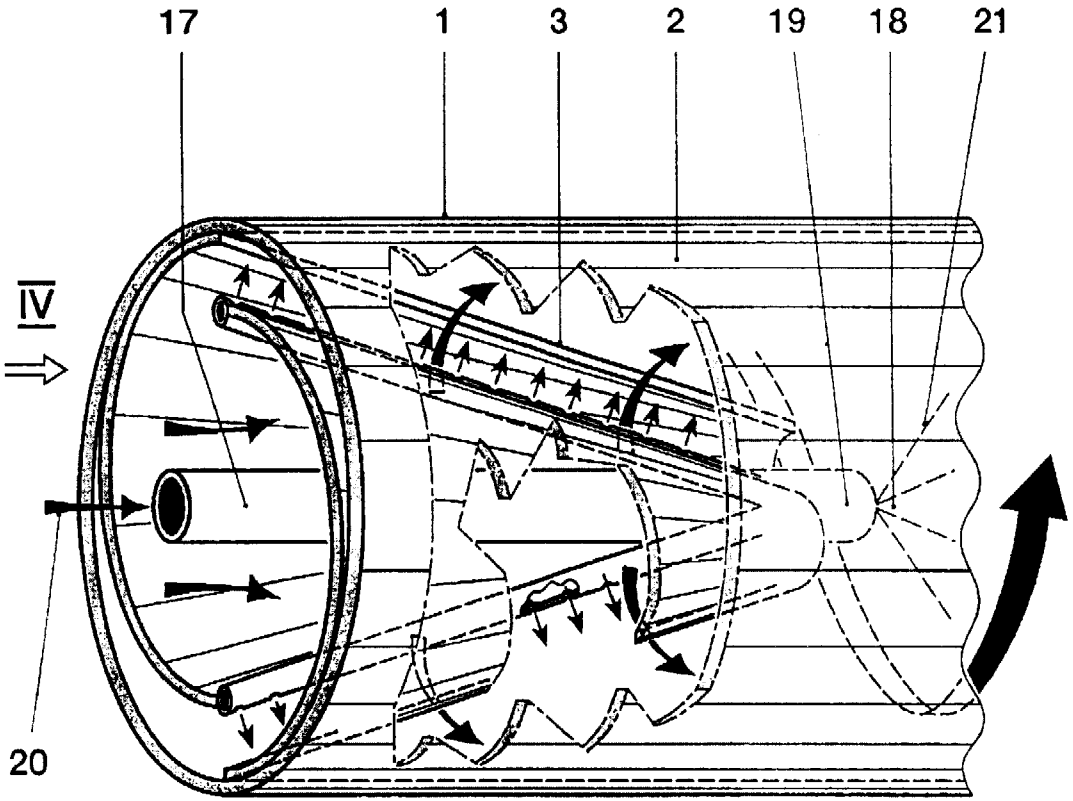
FIG. 3 shows a premix burner supplemented by a head nozzle for injecting a liquid fuel.

FIGS. 3 and 4 differ from FIGS. 1 and 2 in that here a fuel lance 17 extends through the interior space of the swirl generator 3, from which fuel lance 17 the fuel injection 18 into the mixing tube 2 is effected in the region of the tip of the swirl generator 3. This nozzle 19 is preferably operated with a liquid fuel 20, though it is not out of the question to run the nozzle 19 on another fuel. During the injection of a liquid fuel, the free cross section in this plane proves to be an advantage in so far as the oil-spray cone 21, as the figure shows, may be of more generous proportions without running the risk of wetting the walls of the mixing tube 2. Otherwise the configuration of the premix burner 1 here corresponds to that in the preceding figures.

Figure 6:
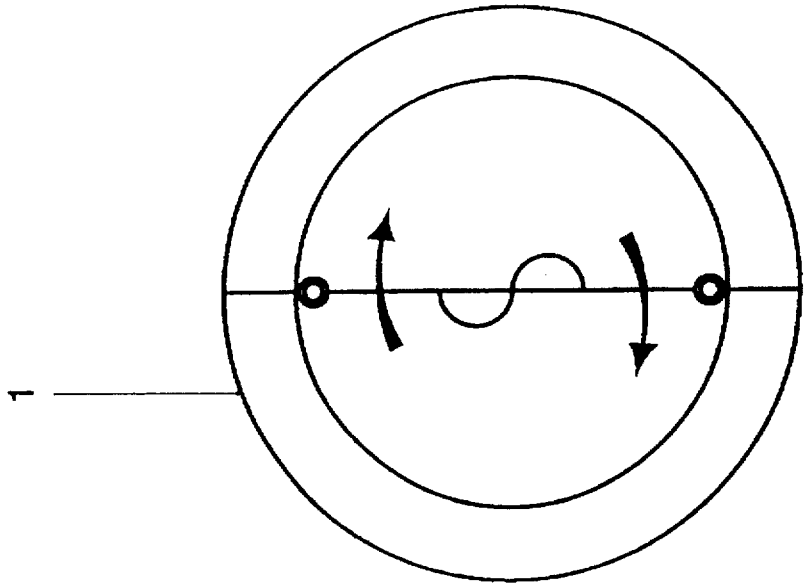
FIG. 6 shows a front view of the premix burner according to FIG. 5, likewise schematically represented.
Figure 5:
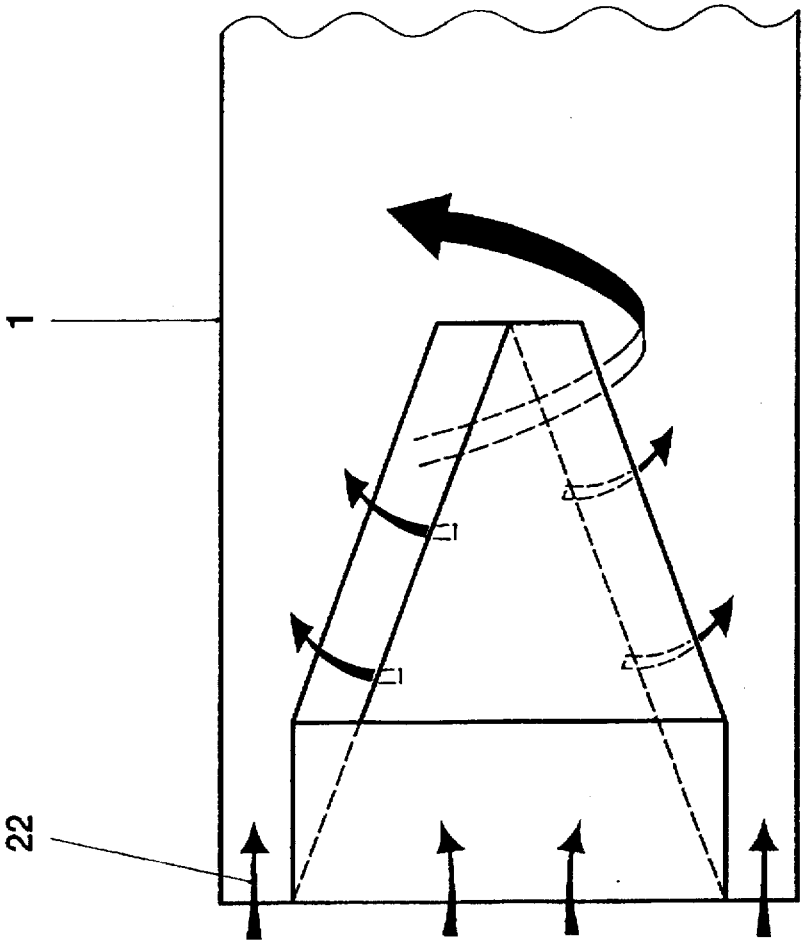
FIG. 5 shows a further schematically represented premix burner having an axial marginal flow.

FIGS. 5 and 6 adopt the configuration in FIGS. 1 and 2 with the difference that the swirl generator 3 additionally permits an annular axial air flow 22. The ultimate purpose of such an air flow is apparent from the description relating to FIG. 1 where it is stated that the formation of the critical swirl number at the correct location may be adjusted by an axial injection of an air flow.

Figure 8:
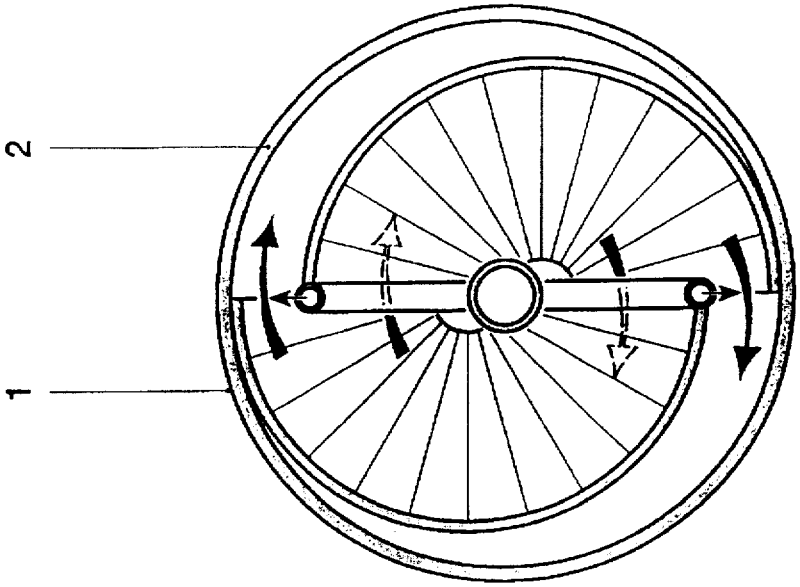
FIG. 8 shows a front view of the premix burner according to FIG. 7.
Figure 7:
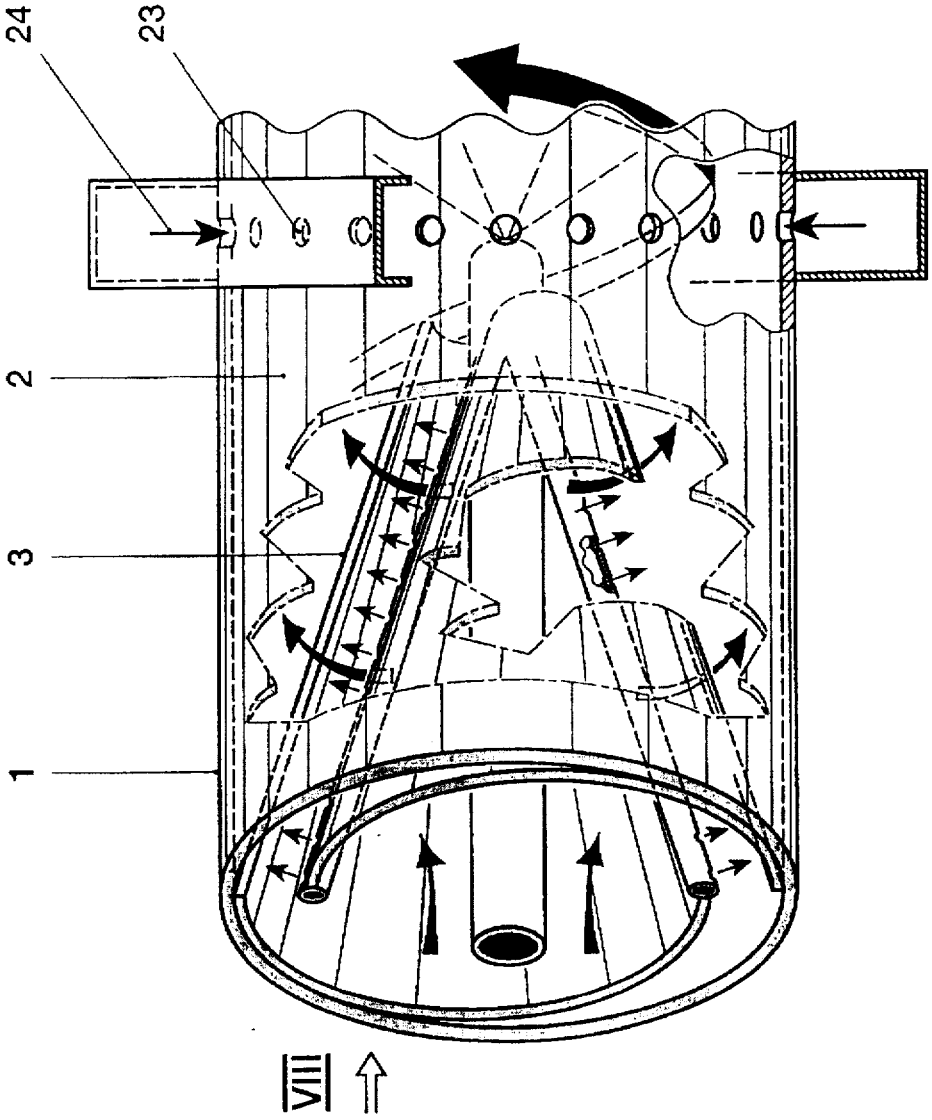
FIG. 7 shows a further premix burner with measures for injecting hydrogenous gases.

FIGS. 7 and 8 are based on FIGS. 3 and 4, means 23 for injecting an MBTU or LBTU gas 24 into the mixing tube 2 being provided here as a further development. This type of injection essentially depends on the fact that the introduction of the requisite large quantity of such a gas 24 can scarcely be brought about by the means of injection at the swirl generator 3.

Figure 10:
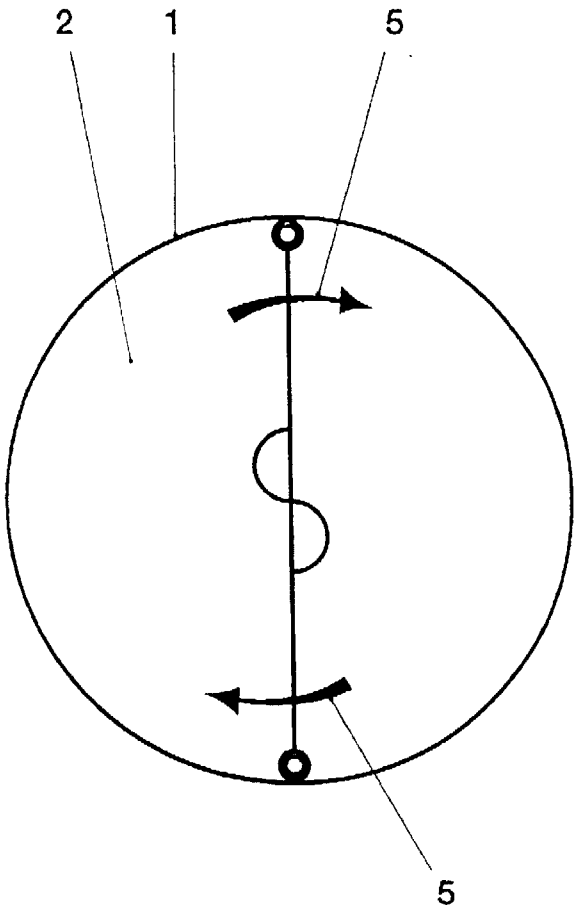
FIG. 10 shows a front view of the premix burner according to FIG. 9, likewise schematically represented.
Figure 9:
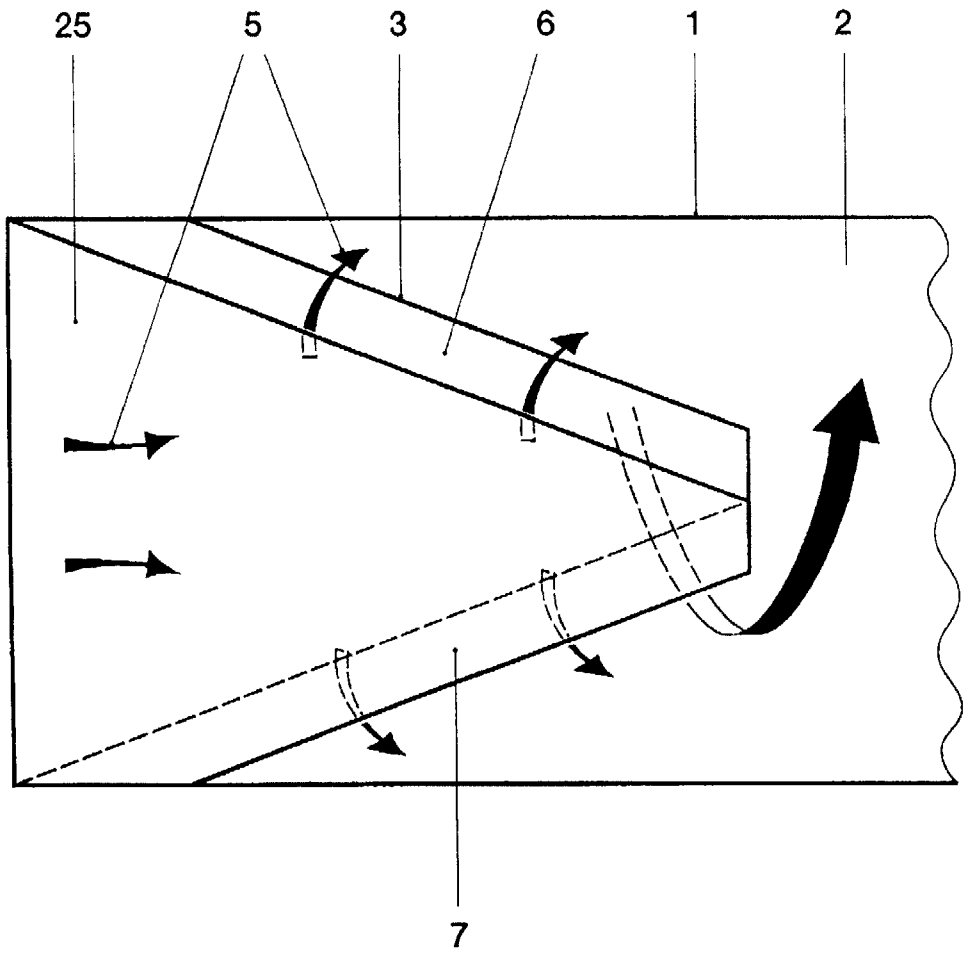
FIG. 9 shows a further schematically represented premix burner, wherein the swirl generator does not cover the entire cross section of the enclosing body.

The premix burner according to FIGS. 9 and 10 essentially refers to FIGS. 1 and 2, the axial inlet opening 25 of this swirl generator 3 being maximized, i.e. the inlet cross section 25 of the swirl generator 3 corresponds to the cross section of the mixing tube 2. The first possible point at which the air flow 5 passes through the tangential ducts 6, 7 lies downstream of the inlet cross section 25. This embodiment is especially useful where the flow in the outer region is to be orientated purely axially or is to be made leaner.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A burner for a heat generator, comprising:

a swirl generator for producing a swirled flow of combustion air, the swirl generator comprising at least two hollow, conical sectional bodies nested adjacent one another to define an interior space that narrows in a longitudinal direction of flow, respective longitudinal symmetry axes of the sectional bodies being mutually offset so that adjacent walls of the sectional bodies form ducts extending longitudinally to allow a tangentially directed combustion-air flow from the interior space, a mixing tube connected to receive the swirled flow from the swirl generator, and means for injecting a fuel in the combustion air flow.

2. The burner as claimed in claim 1, wherein the means of injecting a fuel includes nozzles are arranged in along the tangential openings.

3. The burner as claimed in claim 1, wherein the means of injecting a fuel includes at least one nozzle extending through the interior space of the swirl generator for fuel injection in a region of a downstream tip of the swirl generator.

4. The burner as claimed in claim 1, wherein the means of injecting a fuel includes nozzles disposed in a region of the tangential openings and a central nozzle disposed in a region of a downstream tip of the swirl generator.

5. The burner as claimed in claim 1, wherein a combustion chamber is connected downstream of the mixing tube to receive the air and fuel mixture, wherein a cross section of the combustion chamber is greater than a cross section of the mixing tube so that there is a jump in cross section at a transition between the mixing tube and the combustion chamber, so that in a flow from the mixing tube to the combustion chamber a backflow zone is produced in a region of the jump in cross section.

6. The burner as claimed in claim 1, wherein the swirl generator has a conically decreasing cross section in the direction of flow.

7. The burner as claimed in claim 1, wherein the swirl generator has a shape of a confuser in the direction of flow.

8. The burner as claimed in claim 1, wherein the swirl generator has a shape of a diffuser over at least a longitudinal portion in the direction of flow.

9. The burner as claimed in claim 1, wherein the mixing tube has a cylindrical shape.

* * * * *